US006698569B2

(12) United States Patent
Kaehler

(10) Patent No.: US 6,698,569 B2
(45) Date of Patent: Mar. 2, 2004

(54) PROTECTIVE COVER FOR A VENDING MACHINE BILL VALIDATOR AND STORAGE BOX

(76) Inventor: John D. Kaehler, 6861 Opal Dr., Okeana, OH (US) 45053

( * ) Notice: Subject to any disclaimer, the term of this patent is extended or adjusted under 35 U.S.C. 154(b) by 190 days.

(21) Appl. No.: 09/788,408

(22) Filed: Feb. 21, 2001

(65) Prior Publication Data

US 2002/0130012 A1 Sep. 19, 2002

(51) Int. Cl.[7] ..... G07F 9/00
(52) U.S. Cl. ..... 194/350; 194/353
(58) Field of Search ..... 194/202, 204, 194/344, 350, 353; 109/50–52, 64, 66; 232/15, 31

(56) References Cited

U.S. PATENT DOCUMENTS 1,813,240 A 7/1931 Joseph
1,955,462 A 4/1934 Kaufman
3,083,896 A * 4/1963 Cairelli et al. ..... 232/15
4,131,190 A 12/1978 Gitlin
4,286,814 A 9/1981 Herrington et al.
4,418,551 A 12/1983 Kochackis
4,784,252 A 11/1988 Davis
4,953,683 A 9/1990 Eisermann
5,291,981 A * 3/1994 Anello et al. ..... 194/350
5,321,961 A 6/1994 Barberi
5,544,728 A * 8/1996 Dabrowski ..... 194/206
5,730,271 A * 3/1998 Buchman et al. ..... 194/206
5,791,450 A 8/1998 Oden
5,996,888 A * 12/1999 Gromatzky ..... 232/15

* cited by examiner

*Primary Examiner*—Dean J. Kramer
(74) *Attorney, Agent, or Firm*—Siemens Patent Services, LC

(57) ABSTRACT

The present invention provides a protective cover for the bill validator and storage box of a vending machine, such as a soft drink vending machine. A substantially hollow box, having one open face and having the remaining faces configured to the dimensions of the bill validator and storage box is frictionally fitted over the bill validator and storage box to reinforce the housing of the bill validator and storage box in the event a vandal or thief is able to partially pry the door of the vending machine open and probe the interior of the machine.

6 Claims, 2 Drawing Sheets

PROTECTIVE COVER FOR A VENDING MACHINE BILL VALIDATOR AND STORAGE BOX

BACKGROUND OF THE INVENTION

1. Field of the Invention

The present invention relates to vending machines and the security of monies contained therein. More particularly, the invention comprises a protective cover for the bill validator and storage box of a vending machine.

2. Description of the Prior Art

U.S. Pat. No. 5,791,450, issued to Kenneth W. Oden on Aug. 11, 1998, presents a TAMPER RESISTANT VENDING MACHINE, wherein the cash box, the cash box vault and the coin changer are located away from the normal position proximate the non-hinged side of the door to positions near the center of the door, above the product delivery port. Such arrangement prevents theft from the cash box by prying the door open a minimal amount and reaching into the box at the edge of the door. Oden presents a configuration for a new machine while the present invention presents a retrofit security device for existing machines.

U.S. Pat. No. 5,321,961, issued to Louis J. Barberi on Jun. 21, 1994, presents a SECURITY DOOR FOR COIN OPERATED MACHINE wherein a security door covers the coin deposit and return slots, as well as the coin box area of a video game machine such that deposit and retrieval are possible but digital access for "coin flipping" is denied. Barberi's door is located on the exterior of a video game machine with its hinge protected by the door and a raised ridge around the door. The raised ridge prevents prying of the door from the face of the video machine, and a lock cover prevents cutting of a pad lock securing the door. Barberi presents a retrofit device for the exterior of a machine while the present invention presents an internal security device.

U.S. Pat. No. 5,953,684, issued to Armin Eisermann on Sep. 4, 1990, presents a SAFE EQUIPPED WITH A PERMUTATION LOCK WHOSE LOCKING FUNCTION IS RELEASED BY THE INSERTION OF A COIN OR COINS, wherein a permutation lock, in combination with a coin operated lock, secures a safe deposit box, as in a hotel safe. Eisermann permits use of a safe by a succession of different individuals, with each user being able to change the permutation of the lock after depositing a rental fee. The present invention, on the other hand, provides a security device for the bill validator and storage box of a vending machine.

U.S. Pat. No. 4,784,252, issued to Wallace E. Davis on Nov. 15, 1988, presents a DOUBLE DOOR FRONT LOCKING NEWSPAPER VENDING MACHINE, wherein a newspaper vending box has an open front with a security door with a key operated locking device located therein. Opening of the key operated door provides access to the coin box and other mechanism of the newspaper box, which are located within the box, as opposed to on top of the box, as is commonly found. Within the key operated door is a second door having a coin activated lock which gives access to the newspapers within the box. While providing added security for a newspaper box, Davis is not suitable for protecting the bill validator and storage box of a soda or similar vending machine.

U.S. Pat. No. 4,418,551, issued to Donald G. Kochackis on Dec. 6, 1983, presents a VENDING MACHINE SECURITY CAGE, wherein a cage of metal straps surrounding a vending machine supports a pair of protective doors across the front of a vending machine, such as a juke box, with a padlock located behind the doors locking the doors in place. Kochackis provides reinforcement to the cash box area of the vending machine, but, unlike the present invention, which is an internal reinforcement, can be overcome with a reasonable amount of time or prying devices.

U.S. Pat. No. 4,286,814, issued to Richard P. Harrington, et. al., on Sep. 1, 1981, presents a UNIVERSALLY PIVOTAL PADLOCK AND STAPLE SHIELDING HASP, wherein a reinforced housing designed to receive a padlock is mounted to the exterior of a vending machine so as to protect the padlock from tampering and serve as the hasp for the padlock. While Harrington provides reinforced protection to an external lock, the present invention provides added internal security to the bill validator and storage box within the machine.

U.S. Pat. No. 4,131,190, issued to Harvey Gitlin on Dec. 26, 1978, presents a TAMPERPROOF COIN BOX CLOSURE for a coin operated device such as a washing machine or dryer. These machines typically have a coin slide where coins are inserted vertically into slots in the slide, which is then slid into the machine where the coins drop into a coin box below the slide. Gitlin places an interior horizontal separator plate, having slots sided to receive the various coins, between the coin slide and the coin box, such that once the coins have dropped into the coin box they are more difficult to retrieve from the top, without opening the coin box. The present invention, on the other hand, entirely surrounds the vulnerable faces of the bill validator and storage box.

U.S. Pat. No. 1,955,462, issued to Wolf Kaufman on Apr. 17, 1934, presents a PAY STATION TELEPHONE LOCK, wherein an external housing is situated around the lower portion of a pay telephone to provide additional protection to the phone's coin box. The present invention, on the other hand, provides internal reinforcement to the bill validator and storage box of a vending machine.

U.S. Pat. No. 1,813,240, issued to Theodore H. Joseph on Jul. 7, 1931, presents a LOCK, wherein a hasp is used in association with a typical cylinder or bolt lock to both provide additional external protection to the bolt and activate the bolt when the hasp is placed on the staple. The present invention is installed internal to a vending machine to provide internal protection to the bill validator and storage box.

None of the above inventions and patents, taken either singly or in combination, is seen to describe the instant invention as claimed.

SUMMARY OF THE INVENTION

The present invention presents a means for protecting the bill validator and storage box of a vending machine, such as a soft drink vending machine, from damage by vandals and theft of the monies contained therein. The bill validator and storage box are typically mounted within the door of the machine and located just inside the free swinging side of the door. In this position, they are prone to vandalism and robbery. Added protection for these elements of a vending machine, without major modification to the machine, is highly desirable.

Accordingly, it is a principal object of the invention provide a protective cover for a vending machine bill validator and storage box which provides additional security against vandalism thereto and robbery therefrom.

It is another object of the invention to provide a protective cover for a vending machine bill validator and storage box which can be installed without modifying the existing vending machine.

It is a further object of the invention to provide a protective cover for a vending machine bill validator and storage box which can be removed without damaging the vending machine.

Still another object of the invention is to provide a protective cover for a vending machine bill validator and storage box which is easy to install and remove.

An additional object of the invention is to provide a protective cover for a vending machine bill validator and storage box which is economical to install.

It is again an object of the invention to provide a protective cover for a vending machine bill validator and storage box which may be retained within the vending machine without fasteners or adhesives.

Yet another object of the invention is to provide a protective cover for a vending machine bill validator and storage box which is not easily penetrated or dislodged by vandals or thieves attempting entry into the vending machine.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 2:
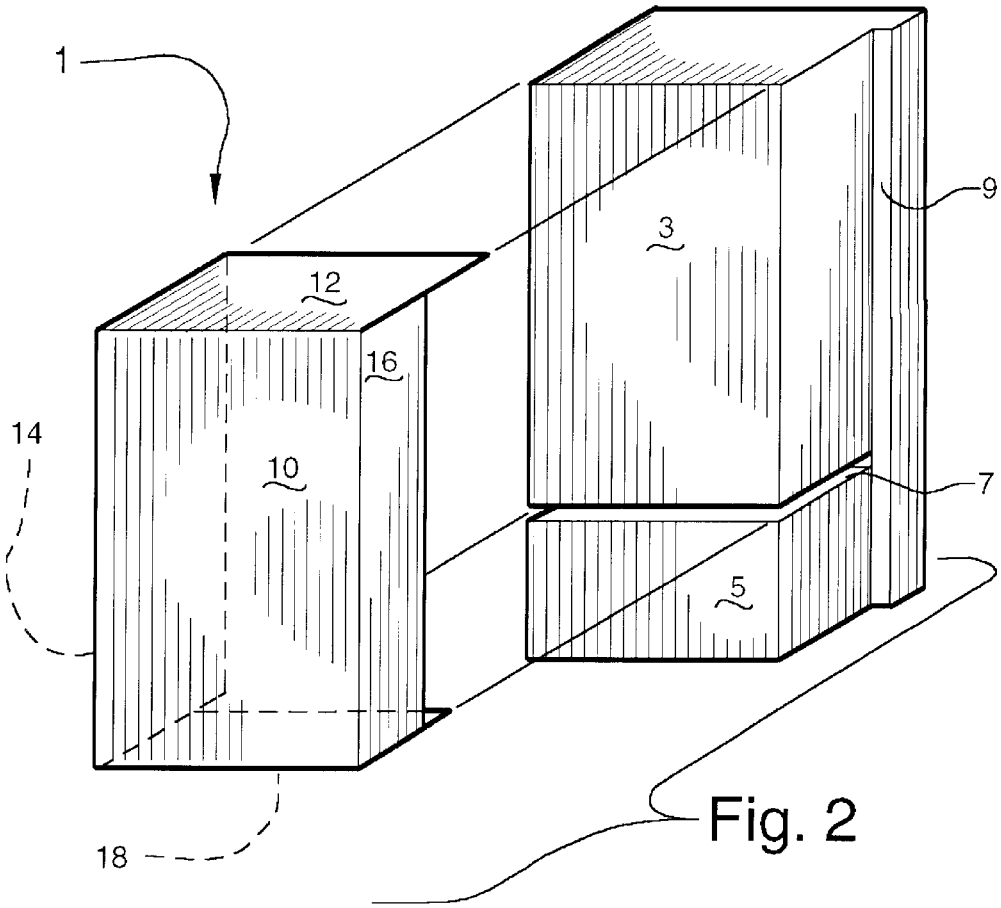
FIG. 2 is an environmental perspective of the invention in relation to a bill validator and storage box in a soft drink vending machine.

Referring first to FIG. 2, there is shown an exploded, perspective view of the inventive cover in relation to a bill validator and storage box in a typical vending machine. In a soft drink vending machine (not shown) the bill validator and storage box 3 are typically mounted in the top portion of the door (not shown) of the machine adjacent to the free swinging side of the door. An electronic control unit 5 is usually located just below the validator 3, with a thin horizontal spacing 7 between the validator 3 and the control unit 5. A vertical housing 9 is typically located to the right and the rear of the validator 3, either immediately adjacent to or physically a part of the housing of the validator 3. Vandals and/or thieves can fairly easily pry open the top of the vending machine door and gain access to the top of the bill validator and storage box 3 with a pry bar or similar device.

Figure 1:
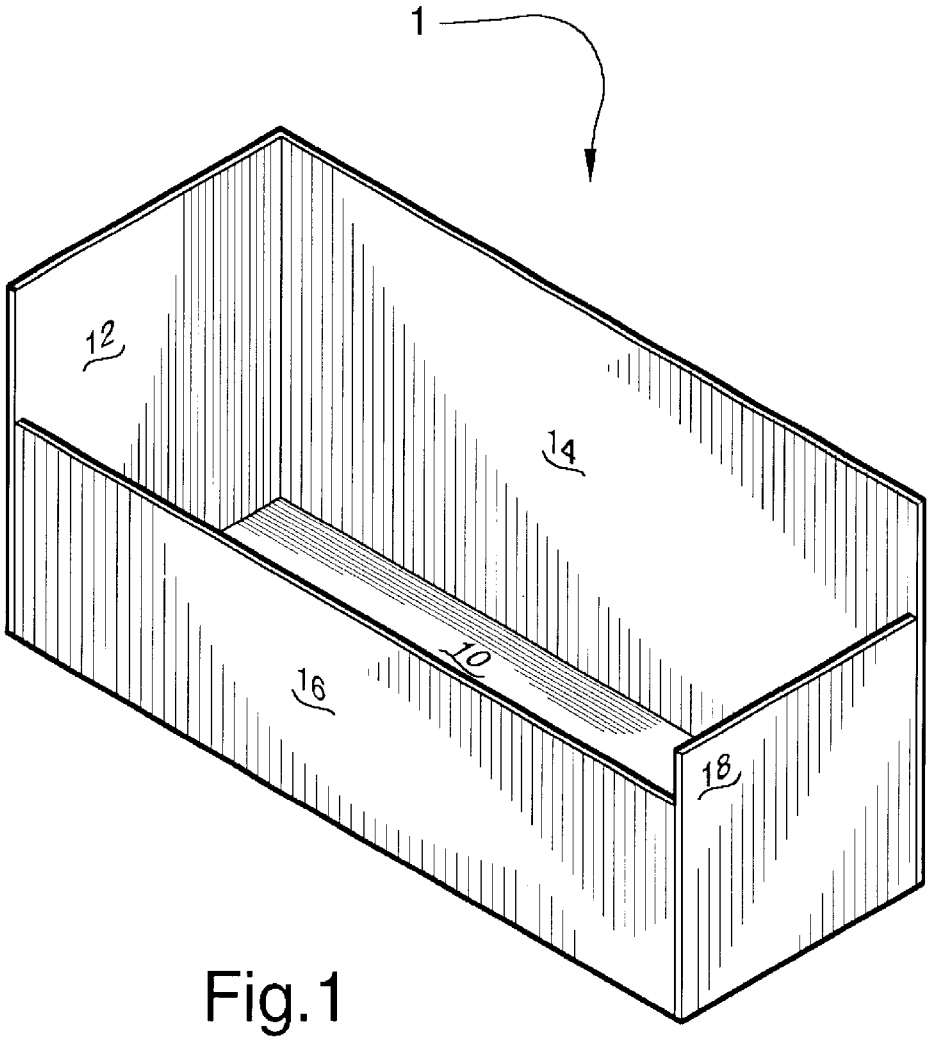
FIG. 1 is a rear perspective view of the protective cover of the invention.

Referring now also to FIG. 1, the protective cover 1, is fabricated of a hard, preferably metallic material, such as, but not limited to, steel, or a molded rugged polymeric.

Protective cover 1 has a back 10 dimensioned to fully cover the back of a vending machine's bill validator and storage box 3. Top 12, normal to the top edge of back 10 is of the same width as back 10 and has a depth sufficient to fully cover the top of the bill validator and storage box 3. Left side 14, normal to the left edge of both back 10 and top 12, has a height equal to that of back 10 and a depth equal to that of top 12, fully covering the left side of the bill validator and storage box 3. Bottom 18, normal to the lower edge of both back 10 and left side 14, has a width equal to that of back 10 and a depth less than that of left side 14. When installed over bill validator and storage box 3, bottom 18 slides into horizontal spacing 7 between bill validator storage box 3 and the control unit 5. Right side 16, normal to the right edges of back 10, top 12 and bottom 18 has a height equal to that of back 10 and a depth less than that of bottom 18, such that when installed, the front edge of the right side 16 abuts vertical housing 9. The protective cover 1 is retained on the bill validator and storage box 3 by frictional fit, without use of fasteners or adhesives.

Installed over the bill validator and storage box 3, protective cover 1 provides an additional measure of protection against vandalism and theft. It can be retrofitted without modifying the existing vending machines, and can be removed without damaging the vending machine.

The preferred embodiment described above is intended for use with validators and storage boxes of the kind most commonly found in soda or similar vending machines, but it would be evident to one skilled in the art that with no modifications or only minor modifications the present invention could be modified to fit other applications.

It is to be understood that the present invention is not limited to the embodiments described above, but encompasses any and all embodiments within the scope of the following claims.

What is claimed is:

1. A protective cover for a vending machine bill validator and storage box comprising:

a back, having
- a height,
- a width, and
- a thickness;

a left side, substantially normal to a left edge of said back, having
- a height substantially equal to said height of said back,
- a depth, and
- a thickness substantially equal to said thickness of said back;

a top, substantially normal to a top edge of said back and a top edge of said left side, having
- a width substantially equal to said width of said back,
- a depth substantially equal to said depth of said left side, and
- a thickness substantially equal to said thickness of said back;

a bottom, substantially normal to a bottom edge of said back and a bottom edge of said left side, having
- a width substantially equal to said width of said back,
- a depth less than said depth of said left side, and
- a thickness substantially equal to said thickness of said back;

a right side, substantially normal to a right edge of said back, a right edge of said top and a right edge of said bottom, having
- a height substantially equal to said height of said back,
- a depth less than said depth of said bottom, and a thickness substantially equal to said thickness of said back;

said protective cover being open on a sixth side and having a hollow interior and being designed and adapted to substantially enclose said bill validator and storage box of a vending machine.

2. A protective cover for a vending machine bill validator and storage box, as defined in claim 1, wherein said protective cover is of a metallic material.

3. A protective cover for a vending machine bill validator and storage box, as defined in claim 2, wherein said metallic material is steel.

4. A protective cover for a vending machine bill validator and storage box, as defined in claim 1, wherein said protective cover is of a polymeric material.

5. A protective cover for a vending machine bill validator and storage box, as defined in claim 1, wherein said protective cover is designed and adapted to be retained upon and around said bill validator and storage box by frictional fit.

6. A method for rendering a bill validator and storage box for a vending machine more resistant to vandalism and theft comprising:

providing a protective cover for a vending machine bill validator and storage box further comprising:

a parallelepiped, having at least one substantially open face, and a substantially hollow interior;

said method further comprising:

frictionally fitting said protective cover over and around said bill validator and storage box such that a back fully covers the back of said bill validator and storage box, a left side fully covers the left side of said bill validator and storage box, a top fully covers the top of said bill validator and storage box, a right side covers the right side of said bill validator and storage box from the back edge of said bill validator and storage box to the back edge of a vertical housing abutting the right side of said bill validator and storage box, and a bottom covers the bottom of said bill validator and storage box, and fits between the bottom of said bill validator and storage box and an electronic control unit below said bill validator and storage box.

* * * * *